United States Patent [19]

Wilcox et al.

[11] Patent Number: 4,513,347

[45] Date of Patent: Apr. 23, 1985

[54] STATIC PROTECTIVE CHAIR

[75] Inventors: Jeffrey S. Wilcox, Grand Rapids; James H. Nienhuis, Wyoming, both of Mich.

[73] Assignee: Herman Miller, Inc., Zeeland, Mich.

[21] Appl. No.: 518,082

[22] Filed: Jul. 28, 1983

[51] Int. Cl.[3] ..... H05F 3/02

[52] U.S. Cl. ..... 361/212; 297/345; 361/220

[58] Field of Search ..... 361/212, 219, 220; 128/376–378; 174/5 R, 5 SB, 5 SG; 297/296, 300, 301, 304, 307, 309, 345; D6/334, 367

[56] References Cited

U.S. PATENT DOCUMENTS

| | | | |
|---|---|---|---|
| 619,896 | 2/1899 | Lee . | |
| 1,744,004 | 1/1930 | Hunt . | |
| 2,302,003 | 11/1942 | Cadwell et al. . | |
| 2,714,181 | 7/1955 | Azbill . | |
| 2,751,523 | 6/1956 | Adams . | |
| 2,753,491 | 7/1956 | Legge | 361/219 |
| 2,786,161 | 3/1957 | Lunden . | |
| 2,802,148 | 8/1957 | Allder . | |
| 3,288,175 | 11/1966 | Valko | 361/212 X |

FOREIGN PATENT DOCUMENTS

| | | |
|---|---|---|
| 2547390 | 10/1975 | Fed. Rep. of Germany . |
| 55-63931 | 5/1980 | Japan . |

OTHER PUBLICATIONS

United Technical Products, Inc.–"Compu-Chair".
Ajusto Equipment Company–"Ship-Now" Models.
Cramer Inc.–"Clean Room Seating".
Doyce Pool–"Seat-Cover Shock Eliminated".

*Primary Examiner*—Harry E. Moose, Jr.
*Attorney, Agent, or Firm*—Varnum, Riddering, Schmidt & Howlett

[57] ABSTRACT

A chair adapted to continuously discharge static electricity has conductive fabric (80, 98) on backrest and seat cushions (18, 14) grounded through conductive plates (84, 100) and staples (88), bolts (34, 68) and T-nuts (62). The backrest bolts (34) are electrically connected to each chair base (16) through a metal bracket (40). The seat bolts (68) are connected directly to the chair base (16). A conductive contact spring (120) is secured to the bottom of a spindle (114) to maintain electrical contact between the spindle (114) and a hub tube (124). A drag cable assembly (140) maintains electrical communication between the base (16) and a floor surface.

24 Claims, 6 Drawing Figures

STATIC PROTECTIVE CHAIR

FIELD OF THE INVENTION

This invention relates to chairs with static protection. In one of its aspects, the invention relates to a chair wherein static electricity generated by the user is continuously discharged to the floor.

STATE OF THE PRIOR ART

Static electricity build-up is a problem in offices as well as in factories. Human beings generate static electricity in most environments and especially in the office where carpeting has insulating properties. Static electricity also tends to build up in a person simply as a result of ordinary use of a chair. Fabrics are typically not conductive and various parts in the chair base are plastic to prevent discharge of electricity through the base. Use of a grounded conductive floor covering will not dissipate static charges in persons who wear shoes with synthetic soles. Static electricity in the office can cause malfunctions in computer equipment and in the factory can change the characteristics of electronic components which are being assembled into electronic equipment.

The concept of grounding automotive seats with conductors in, above or beneath the seat fabric and with ground wires to an automotive body has been known for years. For example, see the U.S. Pat. Nos. to Allder 2,802,148 (issued Aug. 6, 1957), Hunt 1,744,004 (issued Jan. 14, 1930) and Adams 2,751,523 (issued June 19, 1956).

Several chairs have recently been introduced to overcome this static build-up problem. United Technical Products, Inc., of Westwood, Mass., Adjusto Equipment Company, of Bowling Green, Ohio, and Cramer Inc., of Kansas City, Kans., have introduced chairs which apparently use conductive fabric which covers cushions and which is grounded to a metal base. The United Technical Products chair uses a metal caster which may damage conductive tile floors or may unduely wear conductive carpeting. Although these chairs may be functional, they do not have the style and comfort which are frequently demanded of office and factory chairs. These latter chairs contain several wood or plastic parts which interrupt the ground connection between the fabric and the floor.

SUMMARY OF THE INVENTION

According to the invention, there is provided a chair which is adapted to continuously discharge electrostatic charges. The chair is made with the style and comfort of ordinary office chairs and functions in the manner of an ordinary office chair, yet is functionally effective to discharge static electricity as it is generated by the user, or by equipment.

The chair has a conductive base support with a bottom portion adapted to stand on a floor surface. A seat and a backrest are mounted to the base support through traditional insulating shells. A conductive upholstery material is positioned on the seat and the backrest. A first means forming a conductive path free of insulating material is provided through the shells and between the conductive fabric and the conductive base support. A second means forming a conductive path independent of the base bottom portion is provided between the conductive base support and the floor surface.

The conductive base support preferably is a pedestal base of the type wherein legs extend outwardly from a hub tube and a spindle is adjustably mounted for vertical movement within the hub tube. A conductive contact spring is mounted on the spindle and has portions bearing against an inside surface of the hub tube to provide an electrical path between the spindle and the hub tube.

The seat is preferably of the type having a cushion and a staple-retaining layer, such as plywood, beneath the cushion with the conductive upholstery material being drawn around the cushion and secured to the staple-retaining layer through staples. The first conductive path-forming means preferably comprises a thin conductive plate mounted within the seat and outside the staple-retaining layer, and staples penetrate through the staple-retaining layer and through the conductive plate. The first conductive path further includes a nut inside of the seat conductive plate bearing against the staple retaining layer and conductive bolts securing the seat to the base support and threadably secured to the nuts, the bolts extending through the base support and through the staple-retaining layer. Preferably, the nuts are T-shaped and extend through holes in the conductive plate.

The backrest is also preferably of the type wherein the conductive upholstery material is wrapped around a cushion and a staple-retaining layer behind the cushion. Staples extend through the conductive upholstery material and through the staple-retaining layer to secure the upholstery material in place. The first conductive path further comprises a thin conductive plate mounted within the backrest and outside the staple-retaining layer. The conductive staples penetrate through the staple-retaining layer and through the thin conductive plate.

The chair is also preferably of the type wherein the backrest is separated from the seat by a bracket. The first conductive path-forming means further comprises nuts inside the backrest and bearing against the staple retaining layer, conductive bolts securing the backrest to the bracket and threadably secured to the nuts. Preferably the nuts are T-shaped and extend through holes in the conductive plate.

The conductive bracket preferably includes a telescoping tube and rod which allow vertical adjustment of the backrest with respect to the base. A lever mechanism is threaded through a hole in the tube and bears against the rod to maintain the rod in an adjusted position with respect to the tube. The lever mechanism includes a conductive insert and a conductive spring to bias the conductive insert against the rod to maintain conductivity between the tube and the rod regardless of whether the lever mechanism is tightened against the rod.

The second conductive path-forming means includes a flexible conductor secured to the hub and a conductive ball on the end of the flexible connector and adapted to drag along the floor surface. A separate conductor between the hub and the conductor includes an isolating resistor to limit the current flow through the chair to protect the chair user from excess current from live electrical wires which may come in contact with the chair, and from electrostatic potential which the chair user may generate.

Further according to the invention, arms can be provided on the chair and secured to the base. The arms are electrically isolated from the base and are connected to the base through a separate electrical discharge path-forming means which include an isolating resistor to protect the user from excess current from electrical wires which may come in contact with the arms.

In the event that the base has a tilt mechanism which may contain plastic parts, a conductive path is provided around the tilt mechanism to the spindle. The conductive path also can include an isolating resistor.

BRIEF DESCRIPTION OF THE DRAWINGS

The invention will now be described with reference to the accompanying drawings in which.

DESCRIPTION OF THE PREFERRED EMBODIMENT

Figure 1:
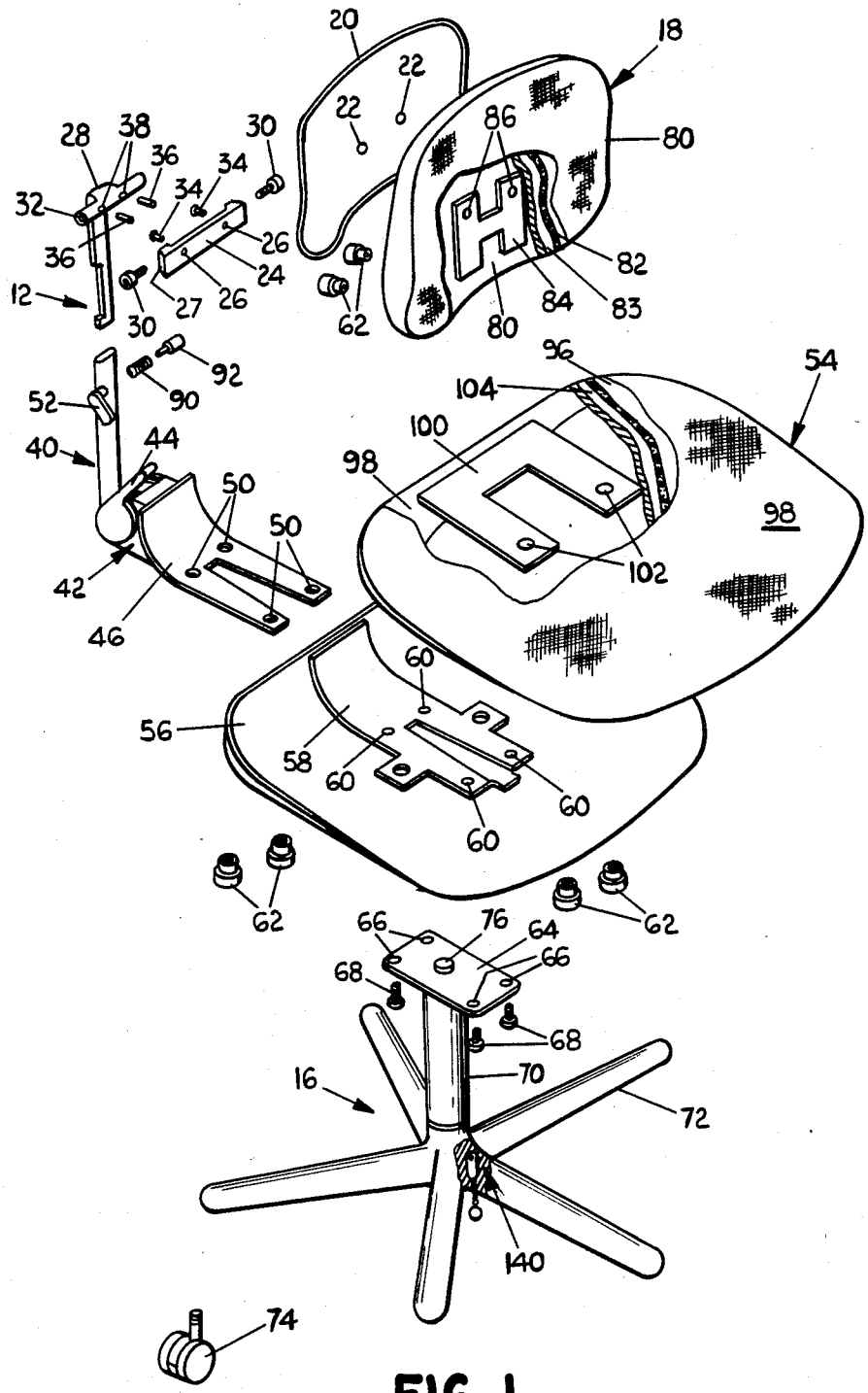
FIG. 1 is an exploded perspective view of a secretarial chair embodying the invention.

Referring now to the drawings, and to FIG. 1 in particular, there is shown a secretarial chair comprising a backrest assembly 12, a seat assembly 14 and a base assembly 16. The backrest assembly 12 comprises a backrest cushion 18, which includes a covering and a foam or other cushion material, and a shell back 20 of plastic or other insulating material having mounting holes 22. The backrest assembly further comprises a pivot T-bar 24 having transverse holes 26 and axial holes 27. The pivot T-bar 24 is connected to the shell back 20 and to the backrest cushion 18 through screws 34 which extend through the holes 26 in the T-bar 24, through the holes 22 in the shell back 20 and threadably engage T-nuts 62 in the backrest cushion 18.

A T-bar 28 having holes 32 is pivotably connected to the pivot T-bar 24 through conductive screws 30 which extend through the axial holes 27 in the pivot T-bar 24 and into the tapped holes 32. T-bar pins 36 extend from holes 38 in the T-bar 28 and abut the T-bar 24 in the rest position of the backrest cushion 18.

A back adjustment bracket 40 has an upper tubular member in which is received the lower portion of the T-bar 28. The relative position of the T-bar within the tubular member of the back adjustment bracket 40 is controlled by a lever mechanism 52. The backrest adjustment bracket 40 is pivotably mounted to a seat attachment plate 46 through a backrest angle adjustment mechanism 42 having a control lever 44. The relative angular position between the back adjustment bracket 40 and the seat attachement plate 46 is controlled by the control lever 44 in conventional fashion. Four mounting holes 50 are provided in the seat attachment plate 46. The seat attachment plate 46 is secured to the backrest angle adjustment mechanism 42 by conventional welding.

A seat pad 54 is provided with a covering and conventional padding and is mounted to a shell seat 56 of plastic or other insulating material. An indentation 58 is provided in the underside of the seat 56 for positioning of the seat attachment plate 46. Holes 60 are provided in the shell seat for registry with the mounting holes 50 of the seat attachment plate 46 when the seat attachment plate 46 is positioned within the indentation 58.

The base assembly 16 comprises a base mounting plate 64 having mounting holes 66, mounting bolts 68 and a set of T-nuts 62. A height adjustment spindle 70 is secured to the base mounting plate 64 conventionally through a bolt 76 and is also secured to a five-arm base 72. Casters 74 or glides are provided on the bottom of the legs 72 in conventional fashion.

The foregoing has been a general description of a prior-art secretarial chair which is manufactured by applicant's assignee, Herman Miller, Inc., of Zeeland, Mich. This chair is made conductive to discharge static electricity generated by the user of the chair in the following fashion.

A conductive upholstery material 80 such as textile or vinyl is provided on the backrest cushion 18. A conventional padding 82 of foam rubber or other types of cushioning material is provided in the cushion. Conventional plywood 83 is provided as a backing to the foam padding 82 and to provide a staple retaining medium to which the upholstery material 80 is attached. A conductive foil or plate 84 is positioned between the plywood 83 and the upholstery material 82. The conductive foil or plate 84 has holes 86. Typically, the conductive foil or plate 84 will be made Typically, the conductive foil or plate 84 will be made of copper or brass and have a thickness of about 0.005 of an inch.

Figure 2:
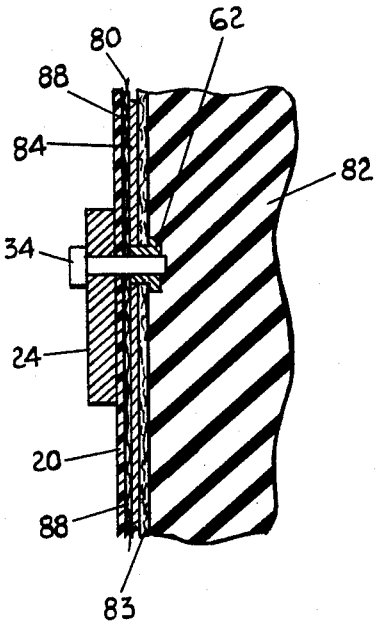
FIG. 2 is a sectional view taken through a portion of the backrest of the chair illustrated in FIG. 1.

Reference is now made to FIG. 2 which shows a cross-sectional view of a portion of the backrest cushion 18 assembled to the pivot T-bar 24. The material 80 is wrapped around the foam cushion 82 and is gathered tightly around the plywood layer 83. Conductive staples 88 are used to staple the conductive upholstery material 80 to the plywood layer 83. The staples penetrate the brass foil or plate 84 and thereby provide a conductive path between the conductive upholstery material 80 and the conductive plate 84. The mounting screws 34, which are conductive, pass through the holes 26 in the pivot T-bar 24, through the holes 22 in the shell 20, through the upholstery layer 80, through the plywood 83 and through the holes 86 in the conductive foil or plate 84. The T-nuts 62 are threaded onto the ends of the screws 34 and bear tightly against the plywood layer 83. The outer ends of the T-nuts 62 are crimped over onto the conductive plate 84. Thus, a conductive path is provided from the upholstery material 80, through the staples 88, through the conductive foil or plate 84, through the T-nuts 62, through screws 34 and to the pivot T-bar 24.

Referring again to FIG. 1, the conductive path is continued to the seat attachment plate 46 through screws 30 and pins 36, through the T-bar 28, through the back adjustment bracket 40, and through the backrest angle adjustment mechanism 42.

A spring 90 and a conductive insert 92, typically made of brass, is provided on the lever 52 to insure contact between the lever mechanism 52 and the T-bar 28. Ordinarily, contact would be maintained by simply tightening the lever 52. However, in the event that the lever 52 is loosened, the spring 90 will force the insert 92 against the T-bar 28, thereby insuring that contact is made at all times between the T-bar 28 and the lever mechanism 52.

The construction of the seat pad 54 is similar to the construction of the backrest cushion 18 shown in FIG.

2. A conductive upholstery fabric 98 is wrapped around a convention foam padding 96 and is secured in place to a plywood layer 104 through conductive staples. A conductive foil or plate 100 of the same nature as the conductive foil or plate 84 is provided on the outside surface of the plywood layer 104. T-nuts 62 would be provided on the inside of the plywood layer 104 to threadably receive the ends of the mounting bolts 68. Thus, in assembling the seat assembly, the seat attachment plate 46 would be positioned in the indentation 58 and the seat shell 56 would be positioned on the base mounting plate 64. Seat cushion 54 would be positioned on the shell 56. The holes 50 in the seat attachment plate 46 would be in registry with the holes 60 in the shell 56 and with the holes 66 in the base mounting plate 64. The holes 102 in the conductive foil or plate 100 would be in registry with two of the holes 50, 60 and 66. The mounting bolts 68 pass through the holes 66, 50, 60 and through two of the holes 102 and are secured in place by the T-nuts 62. The outer ends of the T-nuts extend through the oles 102 of the conductive foil 100 and are crimped over into contact therewith to maintain the electrical contact therebetween. Thus, static electricity generated by the chair user is dissipated to the height adjustment spindle 70 through a conductive path comprising the conductive upholstery material 98, conductive staples 88 which pass through the upholstery material, through the plywood layer 104 and through the conductive foil or plate 100, through Tnuts 62, bolts 68 and mounting plate 64.

Figure 3:
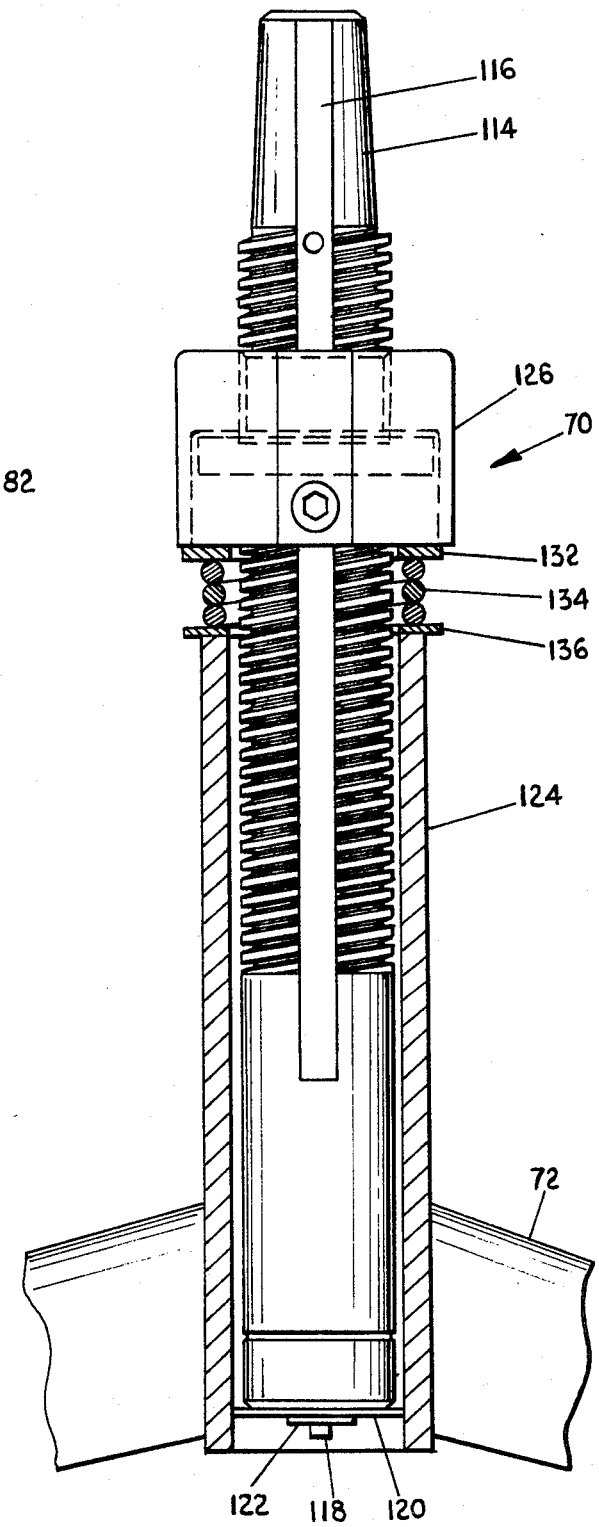
FIG. 3 is a view of a spindle and hub tube, partially in section, which form a portion of the chair illustrated in FIG. 1.
Figure 4:
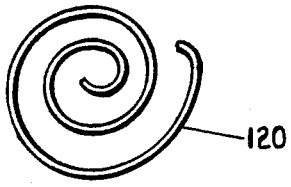
FIG. 4 is a plan view of a spring wiper illustrated in FIG. 3.

Reference is now made to FIG. 3 for a description of the conductive path between the spindle 70 and the base 72. The height adjustment spindle assembly 70 is conventionally constructed of a spindle 114 having a vertical slot 116. The spindle 114 has external threads and is mounted to a hub tube 124 through a hand wheel 126 having an internal thread which engages the threads on the spindle 114, a thrust washer 132, a compression spring 134 and a washer 136. Typically, the nut within the hand wheel 126 and/or one or more of the washers in the mechanism are made from an insulating plastic material so that the conductive path between the spindle and the hub tube 124 is broken. According to an aspect of the invention, a conductive spring wiper 120 is mounted to the bottom of the spindle 114 through a conductive fastener 118 and a washer 122. The shape of the spring wiper 120 is illustrated in FIG. 4. The shape of the spring wiper can vary depending on the relationship between the spindle and the hub tube. The spring wiper 120 can be made of any spring-like conductive metal such as music wire. Thus, the conductive path between the base 72 and the spindle 114 is provided by the spring wiper 120.

Figure 5:
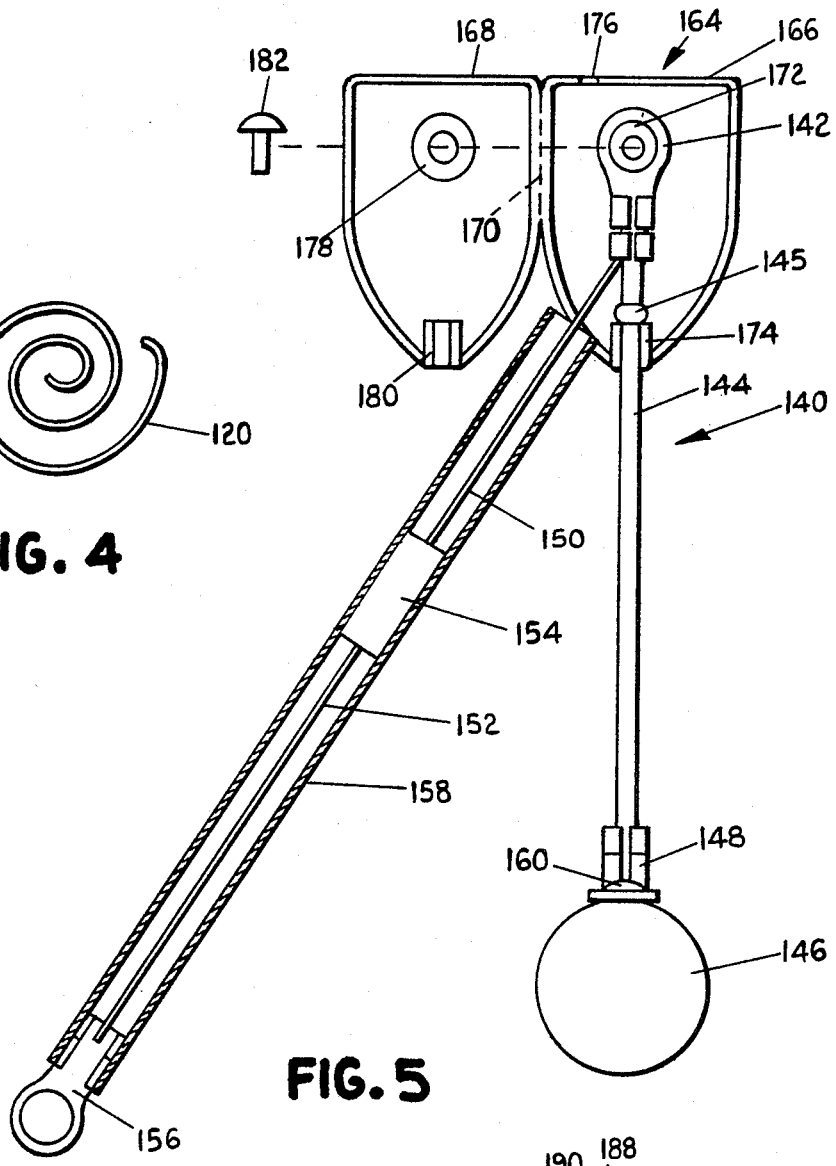
FIG. 5 is a plan view of a ground connection assembly, partially exploded and partially in section.

Reference is now made to FIG. 5 which shows a drag cable assembly 140 which is mounted to the underside of the base 72. The drag cable assembly 140 comprises a terminal ring 142 which is connected to a stainless-steel ball or cadmium plated steel ball 146 through a cable 144, a terminal ring 148 and a pop rivet 160. The cable 144 has an expanded ring portion 145 at an upper portion thereof. The ball 146 is adapted to drag along the floor when the terminal ring 142 is mounted to the base 72. Electrical communication between the cable 144 and the base 72 is provided by a separate conductive path comprising conductive wires 150 and 152 and a resistor 154. The resistor 154 is preferably of a relatively high order, for example, 1 megohm, to reduce the discharge current to a safe level in the event that the cable including the ball encounters a relatively high electrical potential or a live wire. The ring terminal 156 is provided on the end of the conductive wire 152. A sleeve 158 of a plastic material is provided on the outside of the wires 150, 152 and resistor 154. This sleeve is shrunk by solvent or heat to wrap tightly around the wires 150 and resistor 154 to thereby insulate the same.

A clamshell insulator 164 of plastic material is provided to encapsulate the end of the cable 144 and the resistor 154, and to insulate the cable 144 from the base 72. The clamshell insulator 164 is made in two halves 166 and 168 joined together by a living hinge 170. Half 160 has a raised boss 172 on which the terminal ring 142 is positioned. A half cylindrical boss 144 is provided in the bottom portion of half 166 to capture the cable 174 beneath the ring portion 145. An opening 176 is provided in the upper portion of the half 166 to permit wire 158 to pass therethrough. The half 168 has a circular boss 178 which surrounds boss 172 when the halves 166 and 168 are joined together. A half circular boss 180 captures a portion of the cable 144 and, together with boss 174, forms a strain relief for the terminal ring 142 on the cable.

The wire 150, resistor 154 and a portion of wire 158 are folded up inside the insulator 174 with the lower portion of the wire 152 extending through the opening 176. Thus, the terminal 156 is outside the insulator 164. The halves 164 and 166 are closed to encapsulate the terminal 142, end of cable 144, wire 150 and the resistor 144. A pop rivet 182 is then inserted through the center of the boss 172 and into the base 72 with the terminal ring 156 on the pop rivet either adjacent the head or adjacent the base 72. In this way, the base 72 is connected to the cable 144 through a conductive path which includes resistor 154.

Thus, the invention provides a chair in which static electricity generated by the user of the chair is continuously discharged through the floor. The user of the chair is protected against excessive current flow which may occur due to the discharge path coming in contact with high electrical potential, or a live wire.

Figure 6:
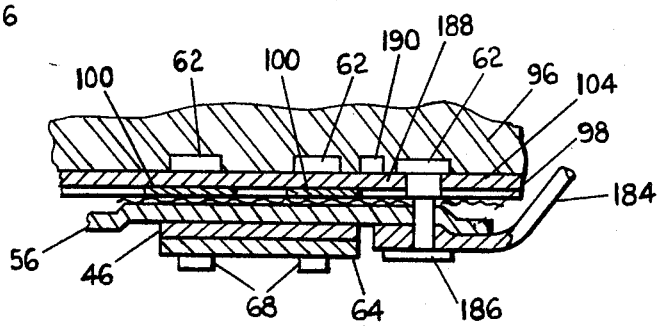
FIG. 6 is a partial sectional view through a chair seat showing an armrest connection to the seat in an alternate form of the invention.

Whereas the invention has been described with reference to a secretarial chair, it can be used in any type of chair. For example, if arms are applied to the chair, a connection can be made between the arms and the conductive foil or plate 100 through a resistorized conductive path of the same nature illustrated in FIG. 5. Thus, discharge can be continuously made between the arms of the chair and the floor while insulating the user from electrical shocks in the event that the chair arms strike a high electrical potential. This alternative embodiment is illustrated in FIG. 6 which is a partial sectional view through the chair seat showing the attachment of an arm 184 to the seat shell 56 through a bolt 186 and a T-nut 62. The bolt 186 passes through holes in the seat shell 56, the arm 164, the upholstery material 98 and the plywood 104. An electrical wire 188 having an insulated resistor 190 is connected between the T-nuts 62 so that the arm 164 is grounded to the conductive foil or plate 100 through the resistor 170.

Further, if a tilt mechanism is used, a resistorized conductive path similar to that illustrated in FIG. 5 can also be used between the chair seat and the spindle to bypass tilt mechanisms. Insulating materials are frequently used in tilt mechanisms and these insulating materials tend to prevent static discharge through the tilt mechanisms.

Reasonable variation and modification are possible within the scope of the foregoing disclosure and drawings without departing from the spirit of the inven- tion.

The embodiments of the invention in which an exclusive property or privilege is claimed are defined as follows:

1. A chair adapted to continuously discharge electrostatic charges which may be generated or carried by a chair user, said chair comprising:

a conductive base support having a bottom portion adapted to stand on a floor surface;

a seat including an insulating shell mounted to the base;

a backrest including an insulating shell mounted to the base;

a conductive upholstery material on said seat and backrest;

first means passing through said insulating shells forming a conductive path free of insulating materials between said conductive upholstery material on said seat and backrest and said conductive base; and second means forming a conductive path between said conductive base support and the floor surface;

wherein electrical charges generated by the chair user are continuously discharged to the floor surface through said first and second conductive path-forming means.

2. A chair according to claim 1 wherein said conductive base is a pedestal base with a hub having outwardly-extending legs, a hub tube extending upwardly from the hub, a spindle adjustably mounted for vertical movement with the hub tube, and wherein the improvement further comprises a conductive spring mounted on the spindle and having portions thereof bearing against an inside surface of the hub tube.

3. A chair according to claim 2 wherein the seat comprises a cushion and a staple-retaining layer beneath the cushion, and the conductive upholstery material is secured to the staple-retaining layer through staples; and wherein the first conductive path-forming means comprises a thin conductive plate mounted within the seat outside of the staple-retaining layer and staples penetrate the staple-retaining layer and the thin conductive plate.

4. A chair according to claim 3 wherein the first conductive path further includes nuts inside of the seat conductive plate and bearing against the conductive plate, and conductive bolts extending from said base support through said conductive plate and threadably engaging the nuts.

5. A chair according to claim 4 wherein the nuts are T-shaped and extend through holes in the conductive seat plate.

6. A chair according to claim 3 wherein the backrest comprises a cushion layer and a staple-retaining layer behind the cushion, and the conductive upholstery material is secured to the staple-retaining layer through staples; and the first conductive path-forming means comprises a thin conductive plate mounted within the backrest outside the staple-retaining layer, and conductive staples which secure the conductive upholstery material to the staple-retaining layer penetrate both the staple-retaining layer and the conductive plate.

7. A chair according to claim 6 wherein a conductive bracket is positioned between the backrest and the base;

the first conductive path-forming means further includes nuts inside of the backrest conductive plate and bearing against the same, and conductive bolts extending from the backrest through the staple-retaining layer and through the backrest conductive plate, threadably secured to the nuts, thereby securing the backrest to the bracket.

8. A chair according to claim 7 wherein the nuts bearing against the backrest conductive plate are T-shaped and extend into holes in the backrest conductive plate.

9. A chair according to claim 7 wherein the conductive bracket includes a tube and a rod telescopingly received in the tube; a lever mechanism is threaded through a hole in the tube and bears against the rod to maintain the rod in an adjusted position with respect to the tube, the lever mechanism includes a conductive insert and a conductive spring to bias the conductive insert against the rod, to thereby maintain conductivity between the tube and the rod, regardless of whether the lever mechanism is tightened against the rod.

10. A chair according to claim 9 wherein the second conductive path-forming means includes a flexible conductor secured to the hub through an insulator and a conductive ball on the end of the flexible connector and adapted to drag along the floor surface; and a separate conductor between the hub and the flexible conductor to provide an electrical path therebetween.

11. A chair according to claim 10 wherein the separate conductor includes an isolating resistor to protect the chair user from excess current flow which may result from the chair coming in contact with live electrical wires.

12. A chair according to claim 11 wherein the conductive base includes a tilt mechanism between the chair seat and the spindle and further including a fourth means forming an electrical discharge path between the chair seat and the spindle.

13. A chair according to claim 1 wherein the seat comprises a cushion and a staple-retaining layer beneath the cushion, and the conductive upholstery material is secured to the staple-retaining layer through the staples; and the first conductive path-forming means comprises a thin conductive plate mounted within the seat outside of the staple-retaining layer, and the staples penetrate the conductive upholstery material, the staple-retaining layer and the thin conductive plate.

14. A chair according to claim 13 wherein the first conductive path further includes nuts inside of the seat conductive plate and bearing against the thin conductive plate, and conductive bolts extend from the base support through the staple-retaining layer and through the seat conductive plate, threadably engaging the nuts.

15. A chair according to claim 13 wherein the backrest comprises a cushion and a staple-retaining layer behind the cushion, and a conductive upholstery material is secured to the staple-retaining layer through staples; and the first conductive path-forming means comprises a thin conductive plate mounted within the backrest outside the staple-retaining layer, and conductive staples penetrate the staple-retaining layer and the thin conductive plate.

16. A chair according to claim 15 wherein the backrest is mounted to the base through a conductive bracket therebetween;

the first conductive path-forming means further includes nuts inside of the backrest and in electrical contact with the conductive plate, and conductive bolts secure the backrest to the bracket and are threadably secured to the nuts.

17. A chair according to claim 13 wherein the second conductive path-forming means includes a flexible connector secured through an insulator hub and a conductive ball on the end of the flexible connector and adapted to drag along the floor surface; and a separate conductor between the hub and the flexible connector to provide an electrical path therebetween.

18. A chair according to claim 17 wherein the separate conductor includes an isolating resistor to limit the discharge current to a safe level and to protect the uses in the event that the chair comes in contact with a live electrical wire.

19. A chair according to claim 1 and further including arms on the chair and secured to the base; and third means forming an electrical discharge path between the arms and the conductive base support.

20. A chair according to claim 19 wherein the third means forming the electrical discharge path includes an isolating resistor to protect the user from shock which may occur if the chair arms come in contact with live electrical wires.

21. A chair according to claim 1 wherein the second conductive path-forming means includes a flexible connector secured to the hub and a conductive ball on the end of the flexible connector and adapted to drag along the floor surface; and a separate conductor between the hub and the ball to provide an electrical path therebetween.

22. A chair according to claim 21 wherein the separate conductor includes an isolating resistor to limit the discharge current to a safe level and protect the chair user in the event that the chair comes in contact with live electrical wires.

23. A chair adapted to continuously discharge electrostatic charges which may be generated or carried by a chair user, the chair comprising:

a conductive base support having a bottom portion adapted to stand on a floor surface;

a seat having an insulating shell mounted to the base through the insulating shell, the seat having a cushion and a staple-retaining layer beneath the cushion, and an upholstery material is secured to the staple-retaining layer through staples;

the improvement which comprises:

the upholstery material on the seat being conductive; a thin conductive plate mounted within the seat outside of the staple-retaining layer and staples penetrating the fabric, the staple-retaining layer and the conductive plate; and means including the conductive plate forming a conductive path between the conductive upholstery material and the floor surface;

whereby electrical charges generated by the chair user are continuously discharged from the seat to the floor surface.

24. A chair according to claim 23 and further comprising nuts inside of the conductive plate and in electrical contact with the conductive plate, and conductive bolts extending from said base through said staple-retaining layer and through said conductive plate and threadably engaging the nut to secure the seat to the conductive base support.

* * * * *